United States Patent [19]

Selwitz

[11] 4,040,956

[45] Aug. 9, 1977

[54] SYNTHETIC FLUSH FLUIDS

[75] Inventor: Charles M. Selwitz, Monroeville, Pa.

[73] Assignee: Gulf Research & Development Company, Pittsburgh, Pa.

[21] Appl. No.: 693,199

[22] Filed: June 7, 1976

[51] Int. Cl.[2] ..... E03D 5/016

[52] U.S. Cl. ..... 210/60; 210/64; 4/10

[58] Field of Search ..... 210/59, 60, 64, 167, 210/195; 4/10, 115, 8, 9; 260/666 P

[56] References Cited

U.S. PATENT DOCUMENTS

| | | | |
|---|---|---|---|
| 3,244,585 | 4/1966 | Stecker | 210/64 |
| 3,673,614 | 7/1972 | Claunch | 210/167 |
| 3,829,909 | 8/1976 | Rod et al. | 4/10 |
| 3,862,034 | 1/1975 | Shema et al. | 210/64 |
| 3,883,303 | 5/1975 | Roberts | 210/64 |
| 3,934,275 | 1/1976 | Bishton, Jr. | 4/10 |
| 3,941,696 | 3/1976 | Melnick et al. | 210/64 |
| 3,974,528 | 8/1976 | Claunch et al. | 210/167 |

*Primary Examiner*—Thomas G. Wyse
*Assistant Examiner*—Benoit Castel

[57] ABSTRACT

A process for disposing of sewage in a synthetic flush fluid recycle toilet facility. Sewage is deposited in a recirculating sanitary system charged with a synthetic flush fluid and is periodically separated and transferred for disposition. The flush fluid is filtered, sanitized, deodorized and recycled for future use.

5 Claims, 1 Drawing Figure

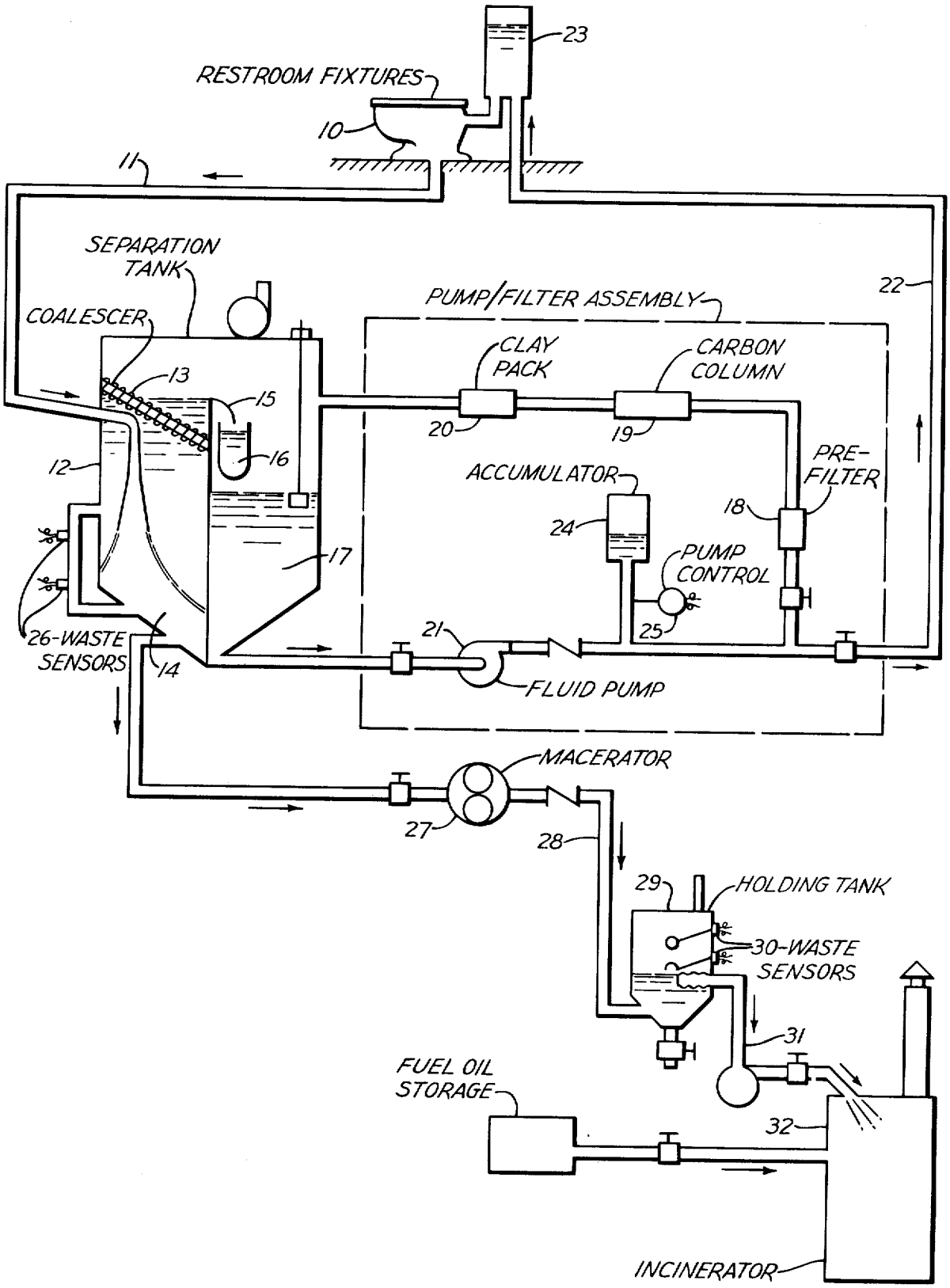
23
RESTROOM FIXTURES
10
11
SEPARATION TANK
COALESCER
13
15
16
12
17
PUMP/FILTER ASSEMBLY
22
CLAY PACK
CARBON COLUMN
20
19
PRE-FILTER
ACCUMULATOR
18
24
PUMP CONTROL
25
21
FLUID PUMP
26-WASTE SENSORS
14
MACERATOR
27
28
29
HOLDING TANK
30-WASTE SENSORS
31
FUEL OIL STORAGE
32
INCINERATOR

SYNTHETIC FLUSH FLUIDS

BACKGROUND OF THE INVENTION

1. Field of the Invention

The invention relates to the disposal of sewage in a recirculating sanitary system utilizing as the sewage carrier a synthetic flush fluid which has a low viscosity, a relatively high flash point, a low pour point and high aniline point. The term sewage as used herein includes human excreta, cigarette butts, paper or any other items typically deposited into a sanitary system such as a toilet.

2. Description of Prior Art

Flush fluid recycling sanitary systems are known in the art. Most recirculating sanitary systems in the past, however, have used water as the flush fluid. Water utilized as the flush fluid in a recirculating sanitary system suffers from the disadvantage of requiring substantial amounts of energy to separate the sewage and process the water for return to the environment.

Another approach to the problem of providing a recirculating sanitary system involves the use of a compound other than water as the flush fluid. For example, U.S. Pat. No. 3,829,909, Rod et al, issued Aug. 20, 1974 discloses a recirculating toilet which utilizes oil in combination with an oil soluble biocide, oil soluble dyes, and deodorizing perfumes as the flush fluid.

U.S. Pat. No. 2,998,390, Hamilton, issued Aug. 29, 1961, relates to a recirculating toilet sump fluid which is described as particularly suitable for use in chemical toilets in vehicles, such as aircraft, busses, trailers, boats, and the like. A foaming agent is incorporated into the sump fluid, which permits the emulsification of air into the liquid for purposes of imparting thereto a clean, nearly white, soapy appearance during flushing. In use the sump fluid comprises an aqueous solution of quaternary ammonium salts, saponin, formaldehyde, oil of musk and oil of cashmere.

SUMMARY OF THE INVENTION

The present invention encompasses an efficient process for disposing of sewage in which an improved synthetic flush fluid receives the sewage, carries the sewage to an apparatus for disposition thereof and is recirculated to receive additional sewage; in which the improved flush fluid comprises a cyclohexylalkane wherein the alkane carbon chain is selected from straight or branched chain alkyl moieties having from 12 to 14 carbon atoms and optionally a bacteriostat and deodorant.

DETAILED DESCRIPTION OF THE DRAWING

A typical recirculating sanitary system suitable for use herein consists of a commode, a separation tank, a pump/filter system, a macerator/holding tank assembly and an incinerator for final disposition of the sewage. Sanitary systems of this type are marketed commercially by the Chrysler Corporation, Space Division under the trade name Aqua Sans, Sewage Treatment system, which system is illustrated in the drawing. In use, sewage is deposited into a commode 10 containing flush fluid and is transported through a line 11 to a separation tank 12 having a sump 14 and storage zone 17 separated by a weir 15. Sewage settles in the sump 14 in separation tank 12, while the flush fluid rises to the top of the separation tank 12 due to the lower density of the flush fluid. The flush fluid passes through a coalescer 13 which removes entrained urine. The synthetic flush fluid next flows over weir 15 through a bag filter 16 into the storage zone 17.

Flush fluid quality is maintained by circulating the fluid through a prefilter 18, an activated carbon column 19 and a clay filter 20. Fine particles and dissolved contaminants such as lipids, surface active agents, color bodies, and some odor producing contaminants are removed by these units. Fluid discharged from clay filter 20 is returned to storage zone 17. Bacteria and odor can additionally be controlled by the periodic addition of bacteriostats and deodorants to the flush fluid.

The flush fluid is recirculated through line 22 to a commode holding tank 23 by the pump 21 which is activated by a pressure switch 25. A bladder type accumulator 24 is provided to prevent surges and meet peak flow conditions.

When sufficient sewage accumulates in the sump 14, it is detected by a sewage sensor 26, which activates a macerator pump 27 to transport the sewage through line 28 to a sewage holding tank 29. A dump switch 30 activates when the tank is half full of sewage and initiates incinerator warm up. The sewage is transferred through line 31 to the incinerator 32 for final disposition.

DETAILED DESCRIPTION OF THE INVENTION

The present invention is based on a process in which a nonaqueous synthetic flush fluid is used in an enclosed recycle sanitary system to dispose of sewage. In a preferred mode, the flush fluid receives the sewage in a receptacle such as a commode or lavatory. The sanitary recirculating system then transfers the sewage to a holding and settling tank where gravity causes the sewage to settle to the bottom of the tank due to the higher specific gravity of said sewage. After the flush fluid rises above the sewage in the holding and settling tank, it passes through a filtering and deodorizing means and is recirculated through the system to again receive sewage.

The sewage collects in the bottom of the holding tank until a sufficient amount has accummulated to activate an automatic grinder and transfer means which transports the sewage to a disposal unit, such as an incinerator or the like.

THE FLUSH FLUID

The flush fluids which are especially suitable for use in the present invention, preferably have a high aniline point, have a low viscosity, a low pour point, a high flash point and readily separate from said sewage upon standing.

A critical step in any recirculating sanitary system involves the separation step wherein sewage settles to the bottom of a holding tank by falling through the flush fluid. The quantity of fluid needed or capacity of the sanitary unit is directly related to the settling time of the sewage, which in turn is directly proportional to flush fluid viscosity and specific gravity. Another critical feature of a recycling sanitary system is the loss of fluid due to entrainment when liquid and solid wastes are removed. A thinner, less viscous flush fluid provides for less entrainment carry-over and a substantial reduction in fluid loss.

It has surprisingly been discovered that the unexpected combination of properties of certain normal mono-cyclohexylalkanes are particularly suitable for use as synthetic flush fluids in the instant process. In particular, those cyclohexylalkanes which have straight or branched alkane chain lengths of from 12 to 14 carbon atoms are especially desirable. It should be additionally noted that cyclohexyalkanes having branched alkyl chains have from 13 to 14 carbon atoms in the alkane chain. The cyclohexyl group is positioned up to 7 carbon atoms from the end carbon position on the alkane carbon chain. Branched chain cyclohexylalkanes are preferably selected from cyclohexyl-methyl-alkanes wherein the methyl group is positioned 2 to 7 carbon units from the end carbon position.

Illustrative cyclohexylalkanes which are especially suitable for use in the present invention include:

cyclohexyldodecane; cyclohexyltridecane; cyclohexyl-tetradecane; cyclohexyl-methyl dodecane; cyclohexyl-methyltridecane; and mixtures thereof. These cyclohexylalkanes have a density of from about 0.75 to about 0.90 at 60° F (15.5° C).

Viscosity as used herein is the property of a fluid that enables it to develop and maintain an amount of shearing stress dependent upon the velocity of flow and then to offer continued resistance to flow. Thus, the viscosity of a flush fluid is important because it determines sewage settling time, loss of fluid due to entrainment, ease of filtering, deodorizing and recirculating the fluid. Suitable flush fluids preferably have a viscosity of no more than about 10 centistokes at 100° F. (37.7° C).

The viscosity as described herein can be determined according to the procedure set forth in ASTM Designation: 88, the disclosure of which is incorporated herein by reference.

The pour point is another critical feature of a suitable flush fluid. As used herein, the pour point is the lowest temperature at which a substance flows under specified conditions. The pour point of a flush fluid is important because it determines the temperatures and conditions under which the fluid retains a viscosity low enough for use in a recirculating sanitary system during winter months, when the temperature may be a factor in determining the feasibility of using a particular fluid in the system. In accordance with the present invention, flush fluids which are suitable for use have a pour point no greater than 0° F. (−17.7° C), with a preferred pour point below −40° F. (−40° C). The pour point is determined according to the procedure set forth in ASTM Designation: 97.

Recirculating flush fluids substantially as described herein are required to have a relatively high flash point in order that they do not present a fire hazard. The flash point of a flush fluid, as described herein, is the lowest temperature at which the vapors above it will ignite in air when exposed to fire. This is an important physical property because the vapors over a fluid with a low flash point may ignite when inflammable materials such as lighted cigarette butts are tossed into the commode. Thus, flush fluids preferably have a flash point above 325° F. (162.5° C), with a flash point above 360° F. (182° C) being especially preferred. The flash point is determined according to the procedure of ASTM Designation: 92, the disclosure of which is incorporated herein by reference.

The lowest temperature at which a standard quantity of aniline goes into solution in a standard sample of a liquid petroleum or organic compound is defined as the aniline point. Many liquid petroleum and organic compounds are excellent solvents for a variety of other compounds and the degree of solvent power varies with the type of hydrocarbons included in the compound. The aniline point is particularly important in a synthetic flush fluid because it is an indicator of the ability of the fluid to dissolve and retain certain sewage components after the separation, filtration and deodorization steps of the recycling procedure. The aniline point of a synthetic flush fluid relates to the incompatibility of the fluid with fatty components and inversely relates to the retention of those foul smelling odors generally associated with sewage. Thus, it is highly desirable for a synthetic flush fluid to have a relatively high aniline point. The flush fluids preferably have an aniline point above about 170° F. (76.6° C), most preferably above about 190° F (87.8° C). The aniline point is determined according to procedures set forth is ASTM Designations: 611 and 1012, the disclosures of which are incorporated herein by reference.

An important feature of a recirculating flush fluid is its appearance after repeated use. It is possible under use conditions for certain color pigments to be leached into the fluid and impart yellow, brown, red or amber colors thereto giving the flush fluid an undesirable appearance. Thus, it is desirable to add oil soluble dyes to the synthetic flush fluid in order to ensure that the fluid will have a pleasing appearance after repeated use.

The source of the dye is not important, the only requirements are that the dye used be substantially soluble in the flush fluid and that it effectively modifies the color of the flush fluid to produce an esthetically acceptable color. Thus, any standard text can be consulted to locate suitable dyes. However, in accordance with the present invention a pleasing appearance is imparted to the fluid by adding thereto a small but effective amount of an oil soluble dye. Suitable oil soluble dyes can be located in Kirk-Othmer, Encyclopedia of Chemical Technology, Second Edition, Volume 7, beginning at page 462; the disclosure of which is incorporated herein by reference. The oil soluble dyes are normally incorporated in the synthetic fluid composition up to about 5.0% by weight; with from about 0.1% to about 2.0% by weight being especially preferred.

It is sometimes desirable to add a deodorant and bacteriostat to the flush fluid under use conditions, because sewage may cling to the inside wall of the commode and the fluid may not come into complete contact with said sewage and unpleasant odors as well as bacterial growth are produced or the fluid may retain foul smelling odors and bacterial growth upon repeated use. Unpleasant odors can be masked by adding an aromatic compound to the flush fluid to act as a deodorant. The aromatic compounds are used in concentrations sufficient to impart a pleasing aroma to the fluid. Thus, deodorants are incorporated into the flush fluid composition at levels of up to about 5.0% by weight, with a concentration of from about 0.01% to about 2.0% by weight being especially preferred. Suitable deodorants are selected from the group of linalool, geraniol, coumarin, acetophenone, salicyl alcohol, vanillin, salicylaldehyde, 3-methylcyclopentadecanone, methyl octine carbonate, styrallyl acetate, oil of cedarwood, oil of cedarleaf, oil of lavender, oil of petigram, oil of lemongrass, lemon oil, oil of rosemary, oil of rose, oil of pine, oil of cashmere, oil of musk, oil of tangerine, oil of bergamol, and mixtures thereof.

Bacteriostats are preferably incorporated into the flush fluid for the express purpose of combating bacterial growth. Because most bacteriostats are not capable of preventing the growth of all bacterial species, it may be desirable to use two or more different bacteriostats to keep the bacterial count below an acceptable level. Relatively small quantities of these compounds are sufficient to render the flush fluids bactericidal. Normally the bacteriostats are used in the flush fluid at concentrations up to about 2.0% by weight of the total composition, with a preferred range of from about 0.001% to about 1.0% by weight being especially preferred. It should be understood that upon repeated recycling of the flush fluid it may be necessary to add additional bacteriostat to keep the bacterial count low.

Suitable bacteriostats can be selected by consulting a standard text of bacteriostats. An important physical property, however, is that the bacteriostat be substantially soluble in the synthetic flush fluid. Bacteriostats which are especially suitable for use herein are selected from the group of bisphenol A, 3,4,5-tribromosalicylanilide, hexachlorobenzene, 3,4,4'-trichlorocarbanilide, hexadecylpyridinum chloride, tetramethylthiuram disulfied, and mixtures thereof.

The following Examples serve to better illustrate and particularly point out the invention.

EXAMPLE I

Preparation of Mixed Cyclohexyldodecanes

A synthetic flush fluid was prepared by mixing 20 grams of aluminum chloride with 1854 grams of benzene in a 5 liter flask. The solution temperature was maintained at 41° F (5° C) with an ice bath. A mixture of 336 grams of normal 1-dodecene in 1253 grams of benzene was slowly added to the solution over a 2 hour period. Upon completion of the reaction, the aluminum chloride was deactivated with aqueous caustic and the solution was washed with water. The benzene was removed from the mixture of phenyldodecanes by distillation at atmospheric pressure and the phenyldodecanes were isolated as a distillation cut at a temperature of 282° F to 284° F (139° C to 140° C), at 1mm of mercury pressure; analysis indicated that 377.8 grams of product was recovered. The recovered product (377.8 grams), 40 grams of Raney nickel and 168.8 grams of cyclohexane were mixed together and heated at 340° F (170° C) under 2000 p.s.i.g.. (140.6 kg./cm$^2$) of hydrogen for 90 minutes. Analysis indicated that 331 grams of normal cyclohexyldodecanes were produced. The cyclohexyldodecanes were analyzed to determine the product distribution with following results.

| Hydrocarbon | Composition (% Wt.) |
|---|---|
| 2-cyclohexyldodecane | 50.15% |
| 3-cyclohexyldodecane | 22.7% |
| 4-cyclohexyldodecane | 9.05% |
| 5-cyclohexyldodecane | 9.05% |
| 6-cyclohexyldodecane | 9.05% |

Analysis indicated that the above synthetic flush fluid composition had a viscosity of 5.9 cs at 100° F (37.7° C); a pour point of −65° F (−53.8° C); an aniline point of 188° F (86.6° C) and a flash point of 330° F (165.5° C).

EXAMPLE II

Preparation of Mixed Cyclohexyltetradecanes

A synthetic flush fluid was prepared by mixing 1380 grams of benzene, 29.9 grams of aluminum chloride and 0.3 grams of water in a 5 liter flask. The mixture was agitated and the temperature was adjusted to 42.8° F (6° C) utilizing an ice bath. Normal-7-tetradecene (445.5 grams) in 960 grams of benzene was slowly added to the 5 liter flask over a 2½ hour period. The catalyst (aluminum chloride) was deactivated with aqueous caustic and the product was then washed with water until the water was neutral.

Excess benzene was removed by distillation at atmospheric pressure using conventional apparatus and the mixed phenylteradecanes were isolated as a distillation cut at 302° F (150° C) to 329° F (165° C) at 1 mm of mecury pressure. The resulting product weighed 527.0 grams. This product (527.0 grams); 40 grams of Raney nickel and 146.3 grams of cyclohexane were heated at 248° F (120° C) to 347° F (175° C) under a pressure of 1900 to 2450 pounds of hydrogen for 3 hours. Analysis indicated that 440.8 grams of mixed normal cyclohexyltetradecanes were recovered. The compound had a viscosity of 8.3 cs at 100° F (37.7° C); a pour point of −65° F (−53.8° C); an aniline point of 197° F (91.5° C); and a flash point of 360° F (182.5° C).

EXAMPLE III

Preparation of Mixed Cyclohexylmethyltridecanes

The procedure of Example II was followed with the following exceptions; a solution of 227.7 grams of 2-butyldecene-1 and 227.7 grams of 2-hexyloctene-1 in 960 grams of benzene were slowly added to the 5 liter flask over a 4 hour period. The temperature was maintained below 95° F (36° C). After the product was isolated, hydrogenated and further processed 198.5 grams of mixed cyclohexylmethyltridecanes were recovered. The resulting compound had a viscosity of 10.0 cs at 100° F (37.7° C); a pour point of −65° F (−53.8° C); an aniline point of 198° F (92.5° C); and a flash point of 365° F (37.0° C).

EXAMPLE IV

A mixture of phenyldodecanes (5%); phenyltridecanes (65%) and phenyltetradecanes (30%) marketed commercially by the Monsanto Company under the designation lab LA230 was hydrogenated using conventional methods to produce the corresponding cyclohexylalkanes. The synthetic flush fluid produced had a viscosity of 7.6 cs at 100° F (37.7° C); a pour point of −65° F (−53.8° C); an aniline point of 192° F (88.8° C) and a flash point of 340° F (171° C).

EXAMPLE V

Preparation of 5-methyl-5-cyclohexylundecane

A mixture of 2206 grams of benzene and 10 grams of aluminum chloride was added to a 5 liter flask. A solution of 144.5 grams of 2 butyloctene-1 in 1366.8 grams of benzene at 42.8° F (6° C) was slowly added to the flash over a 2½ hour period. The procedure of Example II was followed to hydrogenate and isolate the product. Analysis indicated that 108.8 grams of product was recovered.

The flash point of this compound was 295° F (152.7° C) which was too low and is representative of those cyclohexyl alkanes which are unacceptacle for use herein as synthetic flush fluids.

EXAMPLE VI

Cyclohexyldodecanes were prepared according to the method of Example I. A typical flush fluid composition suitable for use in a recirculating sanitary system substantially as described herein comprises the following composition:

| Component | Overall Composition (% wt.) |
|---|---|
| A mixture comprising 50.15% 2-cyclohexyldodecane; 22.7% 3-cyclohexyldodecane; 9.05% 4-cyclohexyldodecane; 9.05% 5-cyclohexyldodecane; and 9.05% 6-cyclohexyldodecane | 98.5% |
| 3,4,4'-trichlorocarbanilide | 0.5% |
| Geraniol | 1.0% |

The above described composition is especially formulated for use in flush fluid recirculating sanitary systems. It should additionally be noted that the above composition will not cause corrosion of metals or other materials with which it is likely to come into contact.

EXAMPLE VII

The method of Example I is followed to prepare a flush fluid of the following composition:

| Component | Overall Composition (% wt.) |
|---|---|
| A mixture comprising 50.15% 2-cyclohexylundecane; 22.7% 3-cyclohexylundecane; 9.05% 4-cyclohexylundecane; 9.05% 5-cyclohexylundecane; and 9.05% 6-cyclohexylundecane | 99.54% |
| Oil of lemongrass | 0.34% |
| Tetramethyl thiuram disulfide | 0.12% |

Recirculating sanitary systems charged with the above flush fluid effectively receive and transport sewage for final disposition. The fluid is suitable for repeated use after the processing and recycling steps are completed.

EXAMPLE VIII

Another preferred formulation for flush fluids consists of the following composition:

| | |
|---|---|
| 1-cyclohexyldecane | 49.3% |
| 1-cyclohexyltetradecane | 49.2% |
| Bisphenol A | 0.5% |
| Acetophenol | 1.0% |

The above composition is especially suitable for use in a synthetic flush fluid recycling sanitary system substantially as described herein.

EXAMPLE IX

A flush fluid composition is formulated by mixing 98.5% (wt.) 2-cyclohexyltridecane with 1.5% (wt.) 2,2'-thiobis (4,6-dichlorophenol). The resulting flush fluid has a low viscosity, high flash point, low pour point and a high aniline point.

EXAMPLE X

A typical flush fluid comprising a mixture of cyclohexyldodecanes is as follows:

| Component | Overall Composition (% wt.) |
|---|---|
| A mixture comprising 50.15% 2-cyclohexyldodecane; 22.7% 3-cyclohexyldodecane; 9.05 4-cyclohexyldodecane; 9.05% 5-cyclohexyldodecane; and 9.05% 6-cyclohexyldodecane | 98.0% |
| P-chloro-meta-xylenol | 2.0% |

The above flush fluid effectively receives and transports sewage for disposal. The fluid can be used repeatedly after the separation and processing steps are completed.

I claim:

1. In a process for disposing of sewage in which a synthetic flush fluid receives the sewage, carries the sewage to apparatus for disposition thereof and is recirculated to receive additional sewage, the improvement which comprises a cyclohexylalkane synthetic flush fluid wherein the alkane carbon chain is selected from straight or branched chain alkyl moieties having from 12 to 14 carbon atoms; and wherein said cyclohexylalkane is selected from the group of cyclohexyldodecane; cyclohexltridecane; cyclohexyltetradecane; cyclohexyl-methyl-dodecane; cyclohexyl-methyl-tridecane; and mixtures thereof, said flush fluid having a viscosity of up to about 10 centistokes at 100° F, a pour point of about 0° F or lower, an aniline point of at least about 170° F, a flash point of at least about 325° F, and a density of from about 0.75 to about 0.90 at 60° F.

2. The process according to claim 1 wherein said synthetic flush fluid contains up to about 2.0 weight percent of a bacteriostat.

3. The process of claim 2 wherein said synthetic flush fluid contains a bacteriostat selected from the group of bisphenol A; 3,4,5-tribromosalicylanilide; hexachlorobenzene, 3,4,4-trichlorocarbanilide; hexadecylphridinum chloride; tetramethylthiuram disulfide, and mixtures thereof.

4. The process according to claim 1 wherein said synthetic flush fluid contains up to about 5.0 weight percent of a deodorant.

5. The process of claim 4 wherein said synthetic flush fluid contains a deodorant selected from the group of linalool, geranoil, coumarin, acetophenone, salicyl alcohol, vanillin, salicylaldehyde, 3-methylcyclopentadecanone, methyl octine carbonate, styrallyl acetate, oil of cedarwood, oil of cedarleef, oil of lavender, oil of pentigram, oil of lemongrass, lemon oil, oil of rosemary, oil of rose, oil of pine, oil of cashmere, oil of mush, oil of tangerine, oil of bergamol, and mixtures thereof.

* * * * *